United States Patent [19]

Briggs et al.

[11] Patent Number: 4,936,031

[45] Date of Patent: Jun. 26, 1990

[54] APPARATUS FOR EXCAVATING SOIL AND THE LIKE USING SUPERSONIC JETS

[75] Inventors: Aubrey C. Briggs, Carnegie; Richard D. Nathenson, Pittsburgh, both of Pa.

[73] Assignee: ACB Technology, Corp., Pittsburgh, Pa.

[21] Appl. No.: 420,561

[22] Filed: Oct. 12, 1989

[51] Int. Cl.[5] ..... B65G 53/14

[52] U.S. Cl. ..... 37/80 R; 37/189; 406/96; 406/153

[58] Field of Search ..... 37/189, 80 R, 259, 260, 37/58, 59, 60, 61, 62, 63, 68, 75, 76, 77, 78; 241/42, 43, 44, 47, 50, 53, 56, 58; 406/39, 88, 92, 96, 153, 164

[56] References Cited

U.S. PATENT DOCUMENTS

| | | | |
|---|---|---|---|
| 2,125,740 | 8/1938 | Schacht | 37/62 |
| 2,518,591 | 8/1950 | Aston et al. | 37/62 X |
| 3,839,875 | 10/1974 | Matsushita | 37/62 X |
| 3,930,324 | 1/1976 | Wightman et al. | 37/189 |
| 4,018,483 | 4/1977 | Smith | 37/58 X |
| 4,087,981 | 5/1978 | Norman | 37/60 X |
| 4,123,858 | 11/1978 | Batchelder | 37/60 X |
| 4,409,746 | 10/1983 | Beck | 37/58 |
| 4,479,741 | 10/1984 | Berti et al. | 37/63 X |
| 4,585,274 | 4/1986 | Grable | 37/58 X |
| 4,776,731 | 10/1988 | Briggs et al. | 406/153 |

*Primary Examiner*—Dennis L. Taylor
*Assistant Examiner*—J. Russell Mcbee
*Attorney, Agent, or Firm*—Richard V. Westerhoff

[57] ABSTRACT

A "soft excavator" utilizes supersonic jets of air to loosen and remove soil and the like without damage to utility lines and other "hard" buried objects. A pair of digger nozzles, each mounted at an angle to the axis of the tubular support shaft which in turn is mounted for planetary motion on a drivehead rotating about a tubular member, trace a epitrochoidal path around the inlet to the tubular member which advances with each rotation of the drivehead to uniformly loosen soil across the cutting face and to gather the lossened soil toward the tubular member. Injector nozzles direct supersonic jets of air into the tubular member in the direction of the discharge end to generate a secondary air flow which sucks lossened soil aerated by the digger nozzles into the inlet end of the tubular member. The entrained soil is decelerated by a diffuser and flexible bag at the discharge end of the tubular member and deposited in a pile.

Compressed air for the digger nozzles is delivered through an annular passage and the stationary tubular member to an annular chamber formed by the rotating drivehead and the stationary tubular member, and passes through radial passageways to the upper ends of the tubular digger nozzle support shafts. The drivehead can be driven by air motors mounted on the rotating drivehead which are supplied with compressed air from the annular chamber feeding the digger nozzles. These rotating air motors engage through idler gears a common sun gear fixed to the tubular member which is also engaged by planet gears rotating the digger nozzle support shafts. Alternatively, the drivehead can be driven by an air, hydraulic or electric motor mounted on the stationary tubular member and driving a separate sun gear mounted on the rotating drivehead.

14 Claims, 5 Drawing Sheets

13
11
12

73
α'
20
72
78
79
76
80
75
68
67
74
β
77
63
69
70
α
66
71
64
65

APPARATUS FOR EXCAVATING SOIL AND THE LIKE USING SUPERSONIC JETS

BACKGROUND OF THE INVENTION

1. Field of the Invention

This invention is directed to apparatus which uses supersonic jets to loosen soil and the like and to convey the loosened material by vacuum from the digging face. More particularly, the invention is directed to such apparatus suitable for excavating around underground services and other buried objects without damaging them.

2. Background Information

Mechanical equipment provides a rapid and economical means for excavating soil and the like. However, such equipment can damage underground services such as gas, water, and sewer lines, and electrical and telephone cables and conduits. Such damage is not only costly, but dangerous to workers and others in the vicinity. For example, reports indicate that a majority of the damage to underground gas lines which has resulted in personal injury or property damage was caused by large mechanical excavation equipment. Damage to utility lines typically occurs when the location of the line is not accurately known and the equipment operator hits the line while excavating. In "busy" soil where multiple utility lines are buried, the only existing safe way to excavate is by hand using shovels. This means of excavation is labor intensive, time consuming and costly. There obviously exists a need to develop a "soft excavation" system that could rapidly loosen and remove soil using a technique that would also minimize the potential of damaging the services being excavated.

It is therefore an object of the present invention to provide apparatus for excavating soil and the like which will minimize the possible damage to underground utility lines and other buried objects in the event of accidental contact.

It is another object of the invention to provide excavating apparatus which will reduce the health and safety hazards to workers and those in the vicinity.

It is yet another object of the invention to reduce the overall cost of small hole excavation.

It is still another object of the invention to minimize the disruption of service and traffic flow while excavating utility lines.

It is an additional object of the invention to provide such apparatus which can also be used economically to excavate other materials such as, for instance, sand, coal and gravel.

SUMMARY OF THE INVENTION

These and other objects are realized by the invention which is directed to apparatus utilizing supersonic jets of gas to dislodge soil and a vacuum to convey the loosened soil away from the digging face. This combination produces a synergistic effect in that the supersonic jets aerate the dislodged soil which aids in vacuuming the loosened soil from the digging face. The apparatus is also useful in excavating soil like materials such as, for example, sand, coal and gravel.

More particularly, the apparatus of the invention includes a tubular member with digging means which dislodges and the like utilizing jets of gas. The digging means is mounted on the inlet end of the tubular member for compound movement to direct the jets of gas in a pattern which repetitively covers, and dislodges and aerates soil and the like from, a selected area around the inlet end of the tubular member. Means for generating suction within the tubular member draws the dislodged and aerated soil and the like into the inlet end, conveys it through the tubular member, and discharges it from the discharge end.

Preferably, the digging means includes a drivehead which is mounted for rotation about the inlet end of the tubular member and one or more jet producing nozzles carried by the drivehead. Means mounting the one or more nozzles on the drivehead for compound movement preferably include supports mounted on the drivehead for rotation about an axis parallel to the axis of rotation of the drivehead and means securing each nozzle in a support with the axis of the nozzle forming an acute angle with the axis of rotation of the nozzle support. This produces epitrochoidal motion of the nozzles over the selected area around the inlet end of the tubular member. Means for rotating the nozzle supports comprise a sun gear fixedly mounted on the tubular member. Planet gears which engage the fixed sun gear rotate the nozzle support means as the drivehead rotates.

Compressed gas to generate the supersonic jets is supplied to the nozzles through an annular passage formed by a sleeve surrounding the tubular member, and an annular chamber formed by the rotating drivehead and the stationary sleeve which communicates with this annular passage. Radial passageways in the drivehead deliver compressed gas from the annular chamber to the rotating nozzles. The nozzles are each supported by a hollow shaft which his mounted on the drivehead for rotation about its own longitudinal axis parallel to axis of the tubular member. The nozzle is connected to the hollow shaft at one end at an angle to the longitudinal axis of the shaft. The other end of the hollow shaft communicates with the radial passageway to supply air to the nozzle. The hollow shaft carrying the nozzle is rotated by the planet gear engaging the fixed sun gear on the tubular member.

The drivehead can be rotated by a motor mounted on the drivehead and driving a planet gear which engages the sun gear fixed to the tubular member. Where the drive motor is an air motor, compressed air is provided through a conduit connected to the annular chamber formed by the drivehead and the sleeve. Two such air motors can be provided for increased power. Alternatively, the motive means may be mounted on the tubular member and drive a planet gear which engages a second, rotating sun gear on the drivehead. With this latter arrangement, the motor remains fixed and rotating connections are not required for the motor power source.

The vacuum for conveying the loosened soil and the like through the tubular member is preferably produced in an injector section. A first injector tubular section has one end face which defines an annular recess. A second injector tubular section has angled bores extending axially toward the discharge end of the tubular member and radially inward from one end face to intercept the longitudinal bore of the tubular section at a selected small angle. The two tubular sections are joined with their one end faces in contact so that the annular recess forms a plenum chamber surrounding the tubular member. Injector nozzles mounted in the angle bores introduce compressed gas from the plenum chamber into the tubular member at the selected small angle at supersonic velocity to generate a secondary air flow which creates a vacuum at the inlet end of the tubular member.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
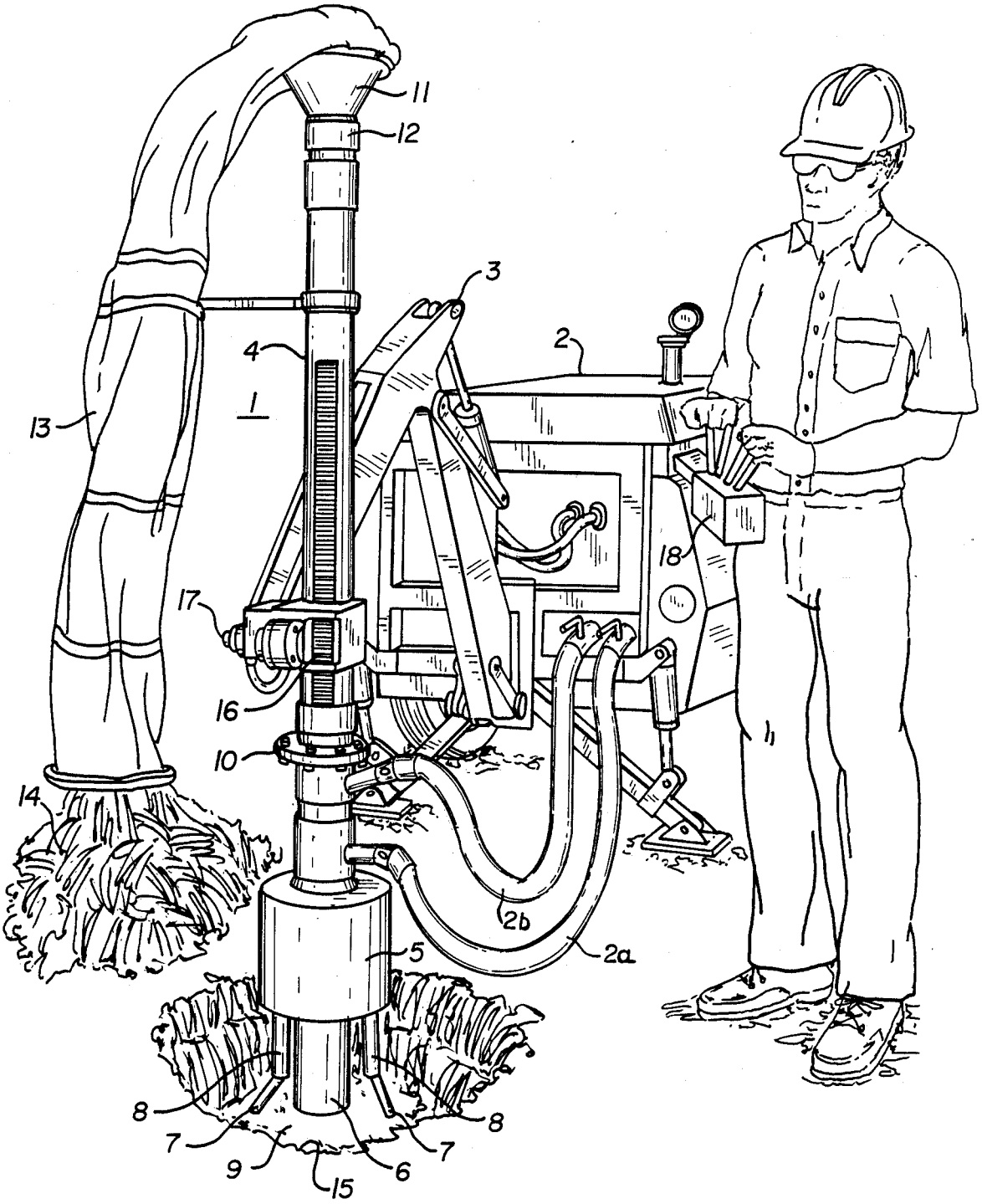
FIG. 1 is a perspective view of the apparatus of the invention in use.

FIG. 1 illustrates the excavating apparatus 1 of the invention mounted on a portable compressor unit 2 by a back hoe mechanism 3. The excavating apparatus includes a tubular member 4, and a digger head 5 mounted adjacent the lower or inlet end 6 of the tubular member 4. The digging head 5 includes a pair of nozzles 7 mounted on the lower ends of support shafts 8. The support shafts 8 rotate about their own axes as the entire digging head 5 simultaneously rotates about the tubular member 4. This imparts compound movement to the nozzles 7 which causes them to repetitively sweep in a pattern which covers a selected area 9 around the inlet end 6 of the tubular member 4.

The nozzles 7 are of the converging/diverging type to be discussed in more detail below which generate supersonic jets from compressed air supplied through the support shafts 8. An example of suitable nozzles is described in detail in commonly owned U.S. patent application Ser. No. 877,280 filed on June 23, 1986 in the name of Aubrey C. Briggs entitled "Method And Apparatus For Excavating Soil And Alike Using A Supersonic Gas". These nozzles are chosen as a "soft excavating tool" because they effectively attack soils and other friable, granular materials, but will not harm nongranular impervious materials such as, for instance, pipes and cables. Utilizing the output of a 100 psig standard air compressor 2 supplied through hose 2*a*, the nozzles 7 accelerate the compressed air into highly concentrated, supersonic (preferably mach 2) streams. These streams penetrate below the surface of even very hard or sticky soils where the air then stagnates and converts its velocity head back to almost initial reservoir pressure. The subsequent expansion of the air back to atmospheric pressure easily fractures and dislodges the soil which is, by nature, inherently weak in tension. The nozzles 7, as discussed below, are flexibly mounted to allow them to move harmlessly out of the way of large objects in the hole such as pipes or other utility lines present in the excavation.

The compound motion of the nozzles 7 results in loosening of the soil over the entire area 9 and gathers it toward the tubular member 4. A suction unit 10 creates a vacuum in the tubular member 4 which draws the soil loosened by the nozzles into the inlet end 6 of the tubular member, raises it up through the tubular member and discharges it through a diffuser 11 at the discharge end 12 of the tubular member 4. The diffuser 11 decelerates the entrained soil and directs it into a discharge sack 13 which further reduces the velocity of the entrained soil and deposits it in a pile 14 along side the excavation 15. The suction unit 10 is powered in a manner to be discussed below by compressed air supplied by the standard compressor unit 2 through hose 2*b*.

It has been found that the combination of the supersonic airstream for loosening the soil with vacuum removal of the soil has a synergistic effect. To date, vacuum removal of soil has been difficult and has required very large pressure differentials in order to initially lift the soil and entrain it in the airstream produced by the vacuum. In our apparatus, the supersonic gas stream which loosens the soil, aerates it at the same time. Thus, the vacuum can more easily lift the soil.

It should be noted at this point that the apparatus of this invention is suitable for use with various types of soil including granular soils, cohesive soils such as clays and some softer rocks such as shale, but not hard rocks. The device can also be used with soil like material such as, for example, piles of sand, coal and gravel.

As soil is loosened and removed from the excavation 15, the excavating device 1 must be lowered. As shown in the exemplary embodiment of the invention in FIG. 1, a rack and pinion mechanism 16 driven by hydraulic motor 17 supplied with pressurized hydraulic fluid from a hydraulic pump (not shown) powered by the power unit 2 raises and lowers the excavating device. The back hoe mechanism 3 which is operated by hydraulic pressure from the same hydraulic pump positions the excavating device over the spot to be excavated. Both means of positioning the excavating device are controlled from an operator's console 18 mounted on the power unit 2. Alternatively, the excavating device 1 and its source of compressed air can be mounted on a truck or other vehicle. Other means can be used in place of the rack and pinion mechanism 16 for raising and lowering the excavating device, such as for example, hydraulic or pneumatic cylinders.

Figure 2A:
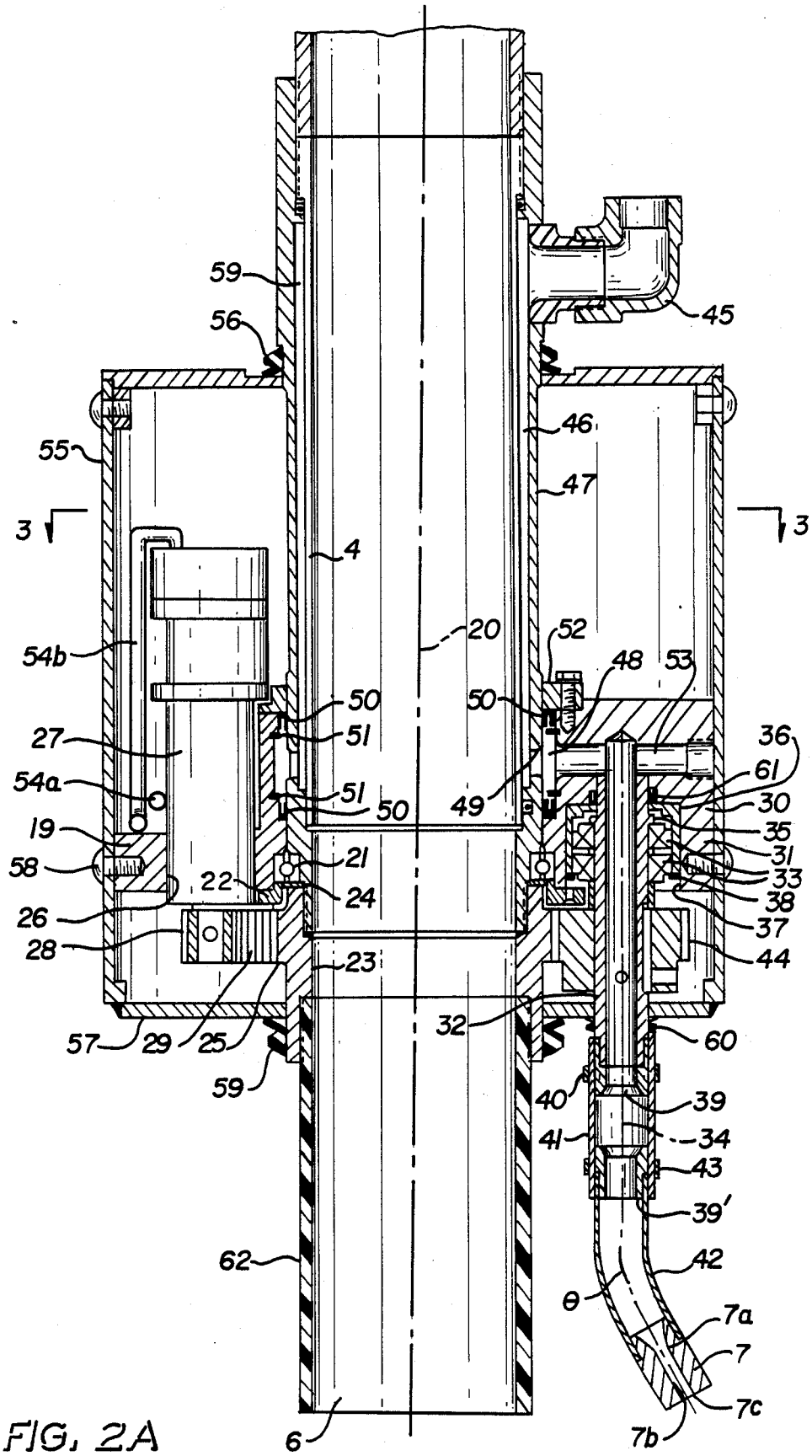
FIGS. 2*a* and *b* when placed end to end illustrate a longitudinal sectional view of the apparatus of FIG. 1 taken along the orthogonal planes indicated by the line 2—2 in FIG. 3.
Figure 2B:
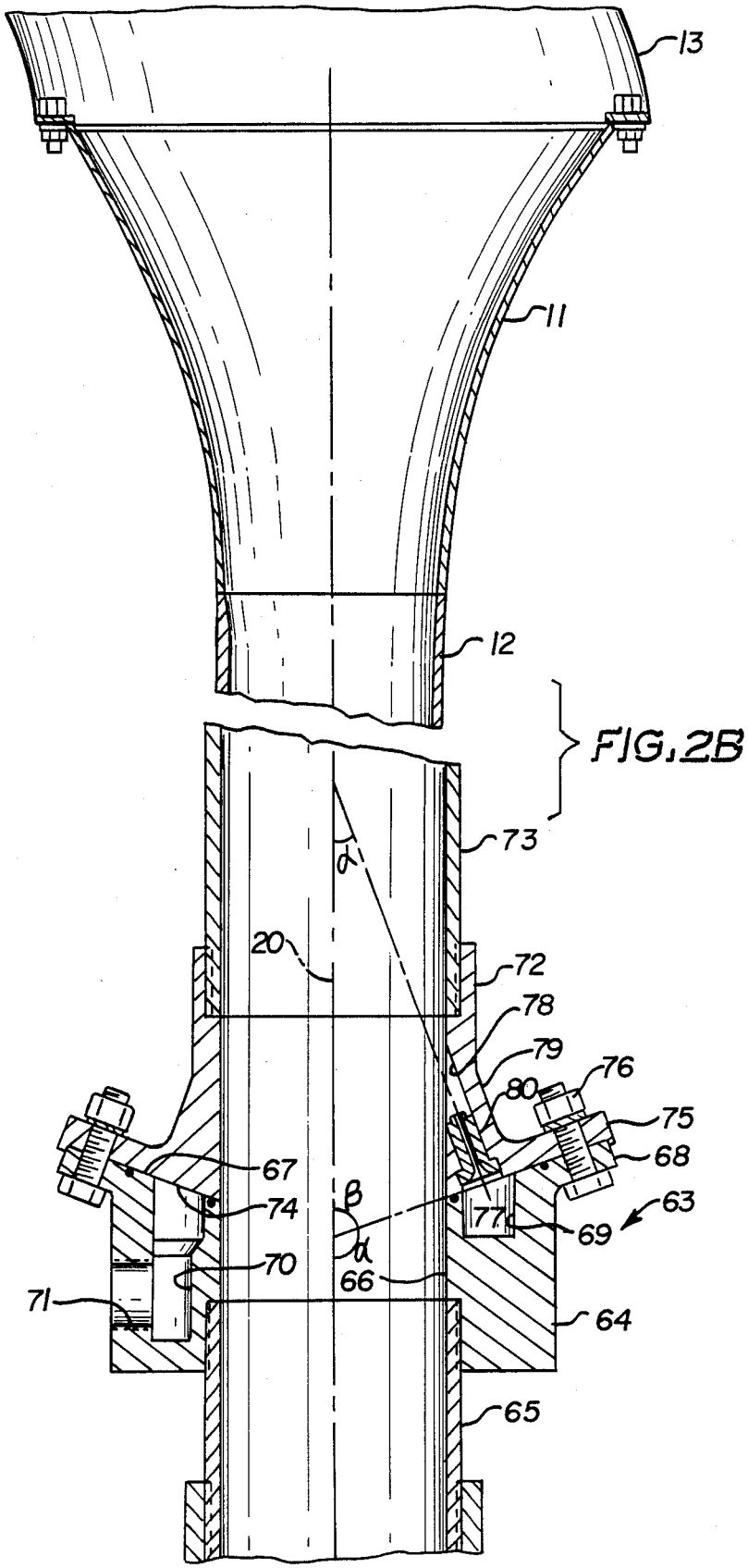
Figure 3:
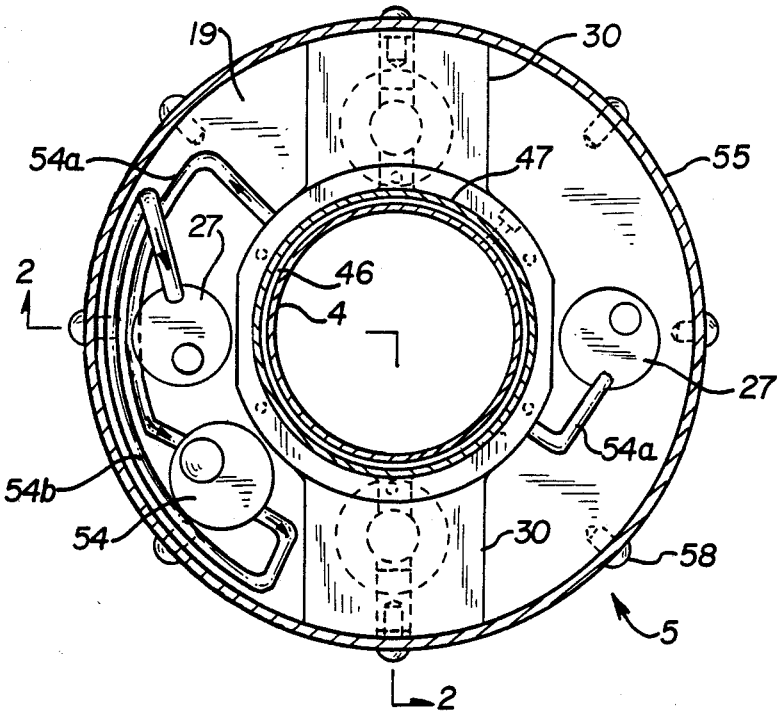
FIG. 3 is a cross-sectional view through the apparatus taken along the line 3—3 indicated in FIG. 2*a*.

FIGS. 2*a* and 2*b* when placed end to end illustrate a longitudinal section through the excavating device taken along split planes as indicated in FIG. 3. As shown from FIGS. 2*a*, and 3, the digger unit 5 includes an annular drivehead 19 mounted adjacent the lower end 6 of the tubular member 4 for rotation about the longitudinal axis 20 of the tubular member 4 by a bearing 21. This bearing 21 takes the radial and axial forces as well as moments imposed on the system from handling loads and from occasional impact loads if the excavator should hit the side of the hole being dug. The outer race of bearing 21 is held in place by a retainer ring 22. The inner race is clamped by a collar 23 threaded onto the tubular member 4. A seal 24 for the bearing 21 is also held in place by the collar 23.

Integral with the collar 23 is a sun gear 25. Mounted in an aperture 26 in the drivehead 19 is an air motor 27. A pinion gear 28 on the shaft on the air motor 27 engages the sun gear 25 fixedly mounted on the drivehead 19. Operation of the motor 27 causes the entire drivehead to rotate about the tubular member 4.

In the exemplary embodiment in the invention, two air motors 27 are similarly mounted 180 degrees apart on the drivehead 19. Each of these motors is rated at 0.40 horse power at 90 psig and 150 revolutions per minute. These air motors have sufficient reserve torque to move the digger nozzles around unforeseen small obstacles in the hole, and can be stalled indefinitely by large objects without harm. The use of two air motors provides a balanced set of forces acting on the tubular member 4. Since as will be seen, the air motors draw their air from the same plenum as the nozzles 7, no additional connections to the supply air compressor are required. Although not shown, auxiliary oilers are also mounted on the drivehead 19 next to the air motors to provide lubrication for the motors. Interestingly, although with the two opposed air motors there is a set of radially opposed net reaction forces, which rotate with the drivehead, acting on the tubular member 4, no net external torque results on the tubular member 4 which must be reacted to ground.

Diametrically opposed axially enlarged portions 30 of the drivehead 19 house support members 31 for the two nozzles 7. Each such support members 31 includes a hollow shaft 32 vertically mounted by a bearing 33 for rotation about its longitudinal axis 34 which is parallel to the axis of the tubular member 4. An integral shoulder 35 retains the hollow shaft 32 in the bearing 33.

The bearing 33 and its cup shaped housing 36 are secured in an aperture 37 in the enlarged portion 30 of the drivehead 19 by a retainer ring 38.

Secured to a support ring 39 by a clamp 40 is a section of flexible house 41. The support ring 39 is screwed onto the lower end of the hollow shaft 32. The nozzle 7 is mounted in a curved tube 42 having a support ring 39' which is clamped to the lower end of the hose section 41 by a clamp 43.

Figure 4:
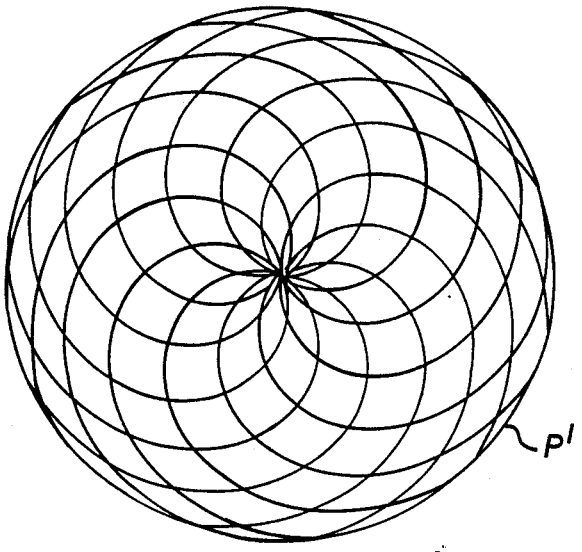
FIG. 4 is an illustration of the pattern traced by the gas jets generated by the digger nozzles of the apparatus shown in FIGS. 2*a* and *b*.

A planet gear 44 secured to the hollow shaft 32 and spaced from the bearing 33 by a spacer **32*a* engages sun gear 25 such that rotation of the drivehead 19 about the tubular member 4 causes the hollow shaft 32 to rotate about its own axis 34. The angle by which the axis of the nozzles is offset from the axis of the hollow shaft member 32 by the curved tube 41 produces epitrochoidal compound motion of the nozzles 7; that is the nozzles follow a path traced by a disk which is itself rotating without slipping on the circumference of another disk. In the exemplary excavating device, the gear ratio between the stationary sun gear 25 and the rotating planet gears 44 was chosen such that the planetary gears 44 turn on their own axes eleven times while making five revolutions around the sun gear 25. Since the number of teeth on the planet gears 44 is not a factor of the number of teeth on the sun gear 25, the pattern traced by the tips of the nozzles 7 advances with each revolution of the drivehead 19. This overlapping pattern P is shown in FIG. 4. This pattern provides good coverage to uniformly loosen soil over the entire area 9 around the inlet end of the tubular member 4. Preferably, the two diametrically opposed nozzles 7 are offset relative to their respective planetary gears 44 so that the patterns, such as shown in FIG. 4**, traced by the two nozzles are offset angularly with respect to each other.

The nozzles 7 are supplied with compressed air from the power unit 2 introduced through a coupling 45 into an annular passage 46 formed between the tubular member 4 and a sleeve 47. This passage 46 formed between the tubular member 4 and a sleeve 47. This passage 46 extends down into radial alignment with an annular chamber 48 formed by the rotating drivehead 19 and the stationary sleeve 47. A number of radial bores 49 equally spaced around the sleeve 47 permit compressed air to pass from the annular passage 46 into the annular chamber 48. Lip seals 50 axially spaced and secured in place by retainer rings 51 seal top and bottom of the annular chamber 48. A seal cover 52 bolted to the top of the drivehead 19 secures the top of the upper seal.

Radially extending bores 53 in the enlarged portions 30 of the drivehead 19 provide passageways for compressed air to pass from the annular chamber 48 into the hollow shafts 32 to the nozzles 7. When the motor 27 is an air motor, compressed air from the annular chamber 48 is passed through a conduit **54*a* to an oiler 54 which adds lubricating oil to the compressed air for delivery to the motor 27 through a conduit 54*b*. The nozzles 7 are of the converging/diverging configuration which produce a chocked sonic flow condition at the throat 7*a* and a supersonic flow in the diverging section 7*b*. The diverging section 7*b* is flared such that the air accelerates smoothly, without shock waves, to produce a maximum velocity in the range of Mach 2 or above at the nozzle outlet 7*c*. The ratio between the cross sectional area of the outlet section 7*c*. The ratio between the cross sectional area of the outlet section 7*c* to the cross sectional area of the throat section 7*a*** of the nozzle should be greater than 1.0 and, and preferably greater than about 1.7, while the ratio of the inlet pressure to the exit pressure of the nozzle is greater than about 1.9 and, preferably greater than about 6.0 whereby, an air jet exits the nozzle having a velocity greater than sonic and, preferably greater than about 2 times the speed of sound.

A cylindrical housing 55 with annular top and bottom end plates, 56 and 57 respectively, is secured to the drivehead 19 by bolts 58 and is sealed top and bottom by V ring seals or the like 59 carried by the tubular member 4. The rotating shafts 32 are sealed against the lower end plate 57 by similar seals 60. The upper end of the hollow shaft 32 is sealed by a lip seal 61 to prevent leakage of air around the shaft from passage way 53.

A tubular extension 62 threaded onto the collar 23 extends the inlet end of the tubular member 4 downward. Preferably this extension 62 is made of a compliant elastomeric material to prevent damage should it come in contact with an underground utility, and to prevent sparks from such impact which could cause a fire or explosion if gas where present. Preferably, the housing 55, end plates 56 and 57 and bolts 19, as well as the nozzles 7, are also made of non-sparking material such as brass or elastomeric material.

The supersonic air jets produced by the nozzles 7 not only loosen soil and the like and aerate it, but also help to direct it toward the inlet end 6 of the tubular member 4. Preferably, the lower ends of the nozzles 7 are located at the same level as the bottom of the tube 6 to enhance this action. This feature could be further enhanced by attaching scoops (not shown) to the air nozzles.

Suction to lift the loosened soil and convey it through the tubular member is provided by an injector section 63 in the tubular member 4 which is shown in detail in FIG. **2*b*. This injector section 63 includes a first tubular section in the form of a cylindrical plenum chamber block 64 which screws onto an intermediate section 65 of the tubular member 4, and has a longitudinal bore 66 of the same diameter as the remainder of the tubular member 4. The upper end face 67 of the plenum chamber block 64 is axially, inwardly beveled at an angle of of about 110 degrees to the longitudinal axis 20** of the tubular member 4, and annular flange 68 outwardly extends this beveled surface 67. An axially extending annular recess 69 is provided in the beveled face 67 of the plenum chamber block 64. An axial bore 70 communicates with a radial bore 71 through which compressed air is introduced into the recess 69.

The injector section 63 also includes a second tubular section in the form of a generally cylindrical nozzle block 72 which threads onto a section 73 of the tubular member. The nozzle block 72 has an end face 74 which extends radially inward and axially outward to form an angle of about 70 to 80 degrees with the longitudinal axis 20 of the tubular member 4 which is supplementary to the angle of the end face 67 of the plenum chamber block 64. The nozzle block also has an annular flange 75 which outwardly extends the surface 74.

The two sections 64 and 72 of the injector section 63 are secured together with the surfaces 67 and 74 in contact with each other by bolts 76 to form from the recess 69 an annular plenum chamber 77. Bores 78 through a tapered thickened section 79 of the nozzle block 72 normal to the surface 74 intercept the bore of the tubular member at an angle which is complimentary to the angle. In the exemplary excavating device, there are three such bores 78 spaced 120 degrees apart around the nozzle block 72.

In each of the bores 78 is an injector nozzle 80 which injects compressed air received from the plenum chamber 77 into the bore of the tubular member at the angle. The nozzles 80 are the the same type as the digging nozzles 7 and are oriented relative to the longitudinal axis 20 of the tubular member 4 at the low angle of incidence preferably of about 10 to 20 degrees. The high velocity (supersonic) flow of air directed by the nozzles 80 toward the discharge end 12 of the tubular member induces a secondary flow in the tube and creates a rise in total pressure across the device which, in turn, results in a vacuum on the inlet end 6 of the tube member. Loose solids are rapidly drawn into the inlet end 6 by the high suction and conveyed through the bore of the tube member 4 to exit at the discharge end 12. The section 73 of the tubular member 4 is provided between the injector section 63 and the outlet end 12 of the excavating device to achieve a complete momentum exchange between the primary gas flow from the nozzles 80 and the secondary flow comprising air plus solids from the suction tube upstream of the injector section 63. This mixing tube section 73 has a length about 6 to 10 times the diameter of the tube bore. The unique two piece construction of the injector section simplifies changing injector nozzles.

The diffuser section 11 mounted on the discharge end 12 of the tubular member 4 comprises a flared tubular member which diverges exponentially from an inlet end to a discharge end. Typically the ratio of the cross sectional area of the discharge end to the cross sectional area inlet end is typically about 4 to 1. The diffuser section 11 serves to decelerate the high velocity gas stream prior to exiting the discharge end of the diffuser section, thus reducing the kinetic energy loss of the air and providing some decelerating effect on the solid particles. A containment device, preferably in the form of a flexible bag 13 having an open bottom, is attached to the discharge end of the diffuser section 11 to further decelerate the entrained solids and discharge them through the open bottom. This flexible bag goes a long way in reducing the problem of clogging which occurs in the bends of conventional vacuum tubes used to move solids which tend to cake.

Figure 5:
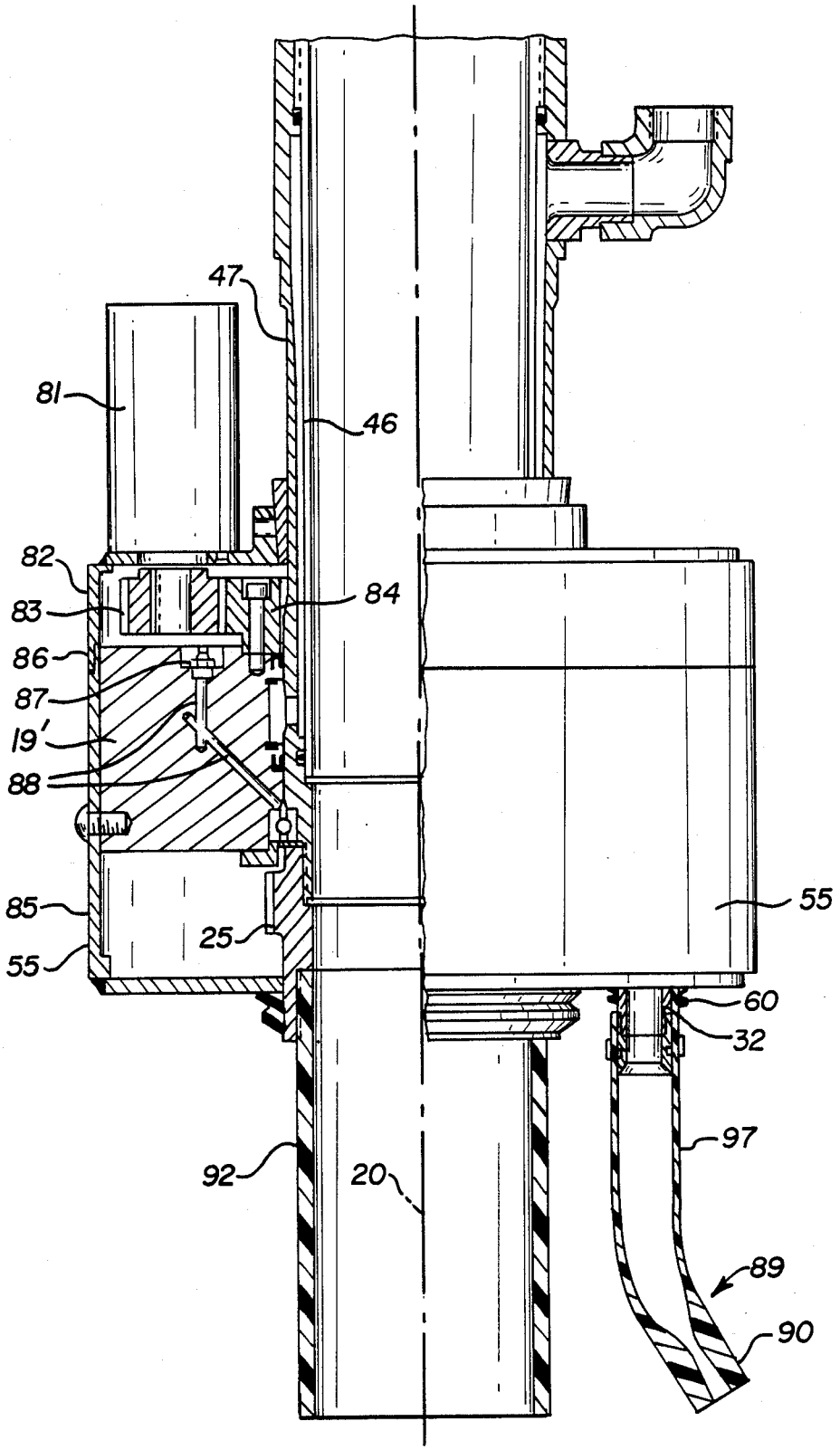
FIG. 5 is a partial longitudinal section similar to FIG. 2*a* through the lower portion of an alternate embodiment of an excavating device in accordance with the invention.

A modification of the digger device 5 shown in FIG. 5 wherein components which are identical to those in the device shown in FIGS. 2*a* and *b* are shown with the same reference characters. Modified components are shown with the primed referenced character. In this embodiment of the invention, the drivehead 19′ is driven by a motor 81 which is stationary rather than being mounted on the drivehead 19′. The motor 81 is mounted on a fixed portion 82 of a housing secured to the sleeve 47 forming an outer portion of the tubular member 4. A pinion gear 83 mounted on the drive shaft of the motor 81 inside the stationary housing 82 engages and drives a second sun gear 84 bolted to the top of the drivehead 19′. The lower half 85 of the housing is still bolted to the drivehead 19′ and rotates with it. These stationary and rotating portions of the housing are rabbeted as at 86 to form a seal. A lubricating nipple 87 communicating with passages 88 which lead to the bearing 21 provide for lubrication of the bearing. The nozzle support shafts 32 are mounted and driven as in the example shown in FIG. 2.

FIG. 5 also illustrates a modified form of the nozzle and its supporting tube, in which a one piece 89 elastomeric nozzle 90 and curved support tube 91 is mounted on the nozzle support shaft 32. Again the gear ratio of the planet gears 44 to the sun gear 25 is such that the nozzles rotate about the axes of shafts 32 eleven times while the drivehead rotates five times so that the pattern traced by the nozzle advances with each revolution of the drivehead. As can be appreciated from FIGS. 2, 4 and 5, the angle at which the nozzle is mounted and the radius of the curved supporting tube can be selectively adjusted to the conditions of the soil being excavated.

In the exemplary device, the tubular member 4 has a four inch bore and the injector is outfitted with three injector nozzles 80 sized to deliver a total of 175 scfm at 90 psig. Tests show that the vacuum performance characteristic is not sensitive to input pressure. However, selection of 90 psig for digger nozzle operation dictates injector pressure when a common source is used. Tests with sandy soil, rocky soil, and gravel all show about the same performance with a secondary mass flow rate of about 3 tons per hour. Using a number of different combinations of inlet vacuum/digger nozzle tip locations, the best soil removal performance appeared to result when the digger nozzle tips were located vertically at the same elevation as the inlet to the tubular member 4 shown in FIG. 2*a*.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. Apparatus for excavating soil and the like comprising:

a tubular member having an inlet end and a discharge end;

digging means for dislodging soil and the like utilizing a supersonic jet of gas;

means mounting said digging means on said tubular member adjacent said inlet end for compound movement to direct said jet of gas in a pattern which repetitively covers, and dislodges and aerates soil and the like from, a selected area around the inlet end of the tubular member; and means for generating suction within the tubular member to draw the dislodged and aerated soil and the like into the inlet end, convey it through the tubular member and discharge it from the discharge end.

2. The apparatus of claim 1 wherein said digging means includes at least one nozzle for generating said supersonic jet of gas, and wherein said mounting means comprises a drivehead rotatably mounted on the tubular member adjacent said inlet end for rotation generally about the longitudinal axis of the tubular member, and nozzle mounting means mounting said nozzle on the drivehead for relative movement with respect thereto to produce said compound movement.

3. The apparatus of claim 2 wherein said nozzle mounting means mounting said nozzle on the drivehead produces relative movement between the nozzle and the drivehead resulting in epitrochoidal motion of the nozzle over said selected area around the inlet end of the tubular member.

4. The apparatus of claim 2 wherein said nozzle mounting means comprises nozzle support means mounted on the drivehead for rotation about an axis parallel to the axis of the rotation of the drivehead and means securing said nozzle in the nozzle support means with the axis of the nozzle forming an acute angle with the axis of rotation of the nozzle support means.

5. The apparatus of claim 4 including means for rotating said drivehead and said nozzle support means comprising sun gear means including at least a first sun gear fixedly mounted on the tubular member, first planet gear means rotatably mounted to engage said sun gear means, motive means for rotating said first planet gear means and thereby rotating the drivehead about the tubular number, and second planet gear means engaging said first sun gear to rotate said nozzle support means.

6. The apparatus of claim 5 wherein the number of teeth on said second planet gear means is not a factor of the number of teeth of said first sun gear such that the path traced by said nozzle means advances with each rotation of the drivehead.

7. The apparatus of claim 5 including a sleeve surrounding the tubular member extending from said rotating drivehead toward the discharge end of the tubular member and forming therewith an annular passage, said drivehead defining with said sleeve an annular chamber which communicates with said annular passage, said drivehead further defining passageway means which connect said annular chamber with said nozzle support means to supply compressed gas introduced into said annular passage and passing through said annular chamber to the nozzle for generating said supersonic jet of gas.

8. The apparatus of claim 7 wherein said nozzle support means comprises hollow shaft means, bearing means mounting said hollow shaft means on said drivehead for rotation about an axis parallel to the axis of the tubular member, means securing said nozzle to one end of said hollow shaft means at a preselected angle to the axis thereof, the other end of said hollow shaft means communicating with said passageway means to supply air to said nozzle means, said second planet gear means being connected to said hollow shaft means to rotate said nozzle.

9. The apparatus of claim 7 including a pair of nozzles each with a nozzle support means mounting said nozzle at diametrically opposed locations on said drivehead.

10. The apparatus of claim 7 wherein said motive means comprises an air motor mounted on said drivehead and conduit means connecting said annular chamber to said air motor to supply compressed gas to drive said motor, and wherein said first planet gear means engages said first sun gear fixedly mounted on said tubular member.

11. The apparatus of claim 5 wherein said sun gear means includes a second sun gear mounted on said drivehead, said apparatus including means mounting said motive means to said tubular member adjacent to said drivehead, and wherein said first planet gear means includes a planet gear driven by said motive means which engages said second sun gear.

12. The apparatus of claim 2 wherein said tubular member comprises an injector section between said inlet and discharge ends, and wherein said means for generating suction with in the tubular member comprises injector nozzles introducing pressurized gas into said injector section at supersonic velocity generally in the direction of the discharge end of the tubular member.

13. The apparatus of claim 12 wherein said injector section comprises a first tubular section defining a longitudinal bore having a diameter essentially the same as that of adjacent sections of the tubular member, and having one end face which defines an annular recess, a second tubular section defining a longitudinal bore having a diameter essentially the same as that of the first tubular section and defining angled bores which extend axially toward the discharge end of the tubular member and radially inward from one end face of the second tubular section to intercept the longitudinal bore of said second tubular section at a selected angle with the longitudinal axis of the tubular member, means securing said tubular sections together with said one end face of each in contact to form from said annular recess a plenum chamber, means for introducing pressurized gas into said plenum chamber, and injector nozzles mounted in said angled bores to introduce said pressurized gas into the longitudinal bore of the second tubular section at said selected angle.

14. The apparatus of claim 13 wherein the one end face of each of the tubular sections is normal to said bores in the second tubular section to form an annular beveled surface which forms an angle with the longitudinal axis of the tubular member which is complimentary to the selected angle and wherein said means for securing said tubular sections together includes annular flanges on each tubular section which extend said beveled surface outward and means clamping said annular flanges together.

* * * * *